US005628118A

United States Patent [19]

Rivera

[11] Patent Number: 5,628,118

[45] Date of Patent: May 13, 1997

[54] MINI-DRAFTING MACHINE

[76] Inventor: Teodorico M. Rivera, Dumez Co. JSWD, P.O. Box 33166, Jeddah 21448, Saudi Arabia

[21] Appl. No.: 518,665

[22] Filed: Aug. 24, 1995

[51] Int. Cl.[6] ..... B43L 13/02

[52] U.S. Cl. ..... 33/449; 33/27.03; 33/471; 33/565

[58] Field of Search ..... 33/27.03, 448, 33/449, 450, 562, 563, 565, 471, 470, 472, 473

[56] References Cited

U.S. PATENT DOCUMENTS

| | | | |
|---|---|---|---|
| 1,281,790 | 10/1918 | Kirk | 33/449 |
| 2,332,865 | 10/1943 | Miller | 33/450 |
| 2,893,127 | 7/1959 | McIntosh | 33/449 |
| 3,216,115 | 11/1965 | Simerl | 33/449 |
| 3,604,118 | 9/1971 | Miller | 33/474 |
| 4,670,991 | 6/1987 | McKay et al. | 33/449 |
| 4,736,526 | 4/1988 | Hsia | 33/27.03 |
| 5,131,157 | 7/1992 | Hoagland | 33/448 |
| 5,193,284 | 3/1993 | Lin | 33/449 |
| 5,426,859 | 6/1995 | Concari et al. | 33/27.03 |
| 5,433,012 | 7/1995 | Liu | 33/449 |

FOREIGN PATENT DOCUMENTS

| | | | |
|---|---|---|---|
| 3110 | 2/1897 | United Kingdom | 33/449 |

*Primary Examiner*—Thomas B. Will
*Attorney, Agent, or Firm*—Michael I. Kroll

[57] ABSTRACT

A mini-drafting machine that is structured so that it can be guided horizontally and vertically along a flat surface, such as a piece of paper. Horizontal, vertical and diagonal lines, as well as different sized arcs and circles, can be drawn upon the flat surface. Different sized geometric shapes can also be made upon the flat surface with built-in templates. The lengths of the vertical, horizontal and diagonal lines can be measured, while the angle of the diagonal lines can be determined.

11 Claims, 4 Drawing Sheets

MINI-DRAFTING MACHINE

BACKGROUND OF THE INVENTION

1. Field of the Invention

The instant invention relates generally to drawing instruments and more specifically it relates to a mini-drafting machine.

2. Description of the Prior Art

Numerous drawing instruments have been provided in prior art that are adapted to assist people in drafting, layout, design work, architectural drawing, pattern-making and other types of artwork. While these units may be suitable for the particular purpose to which they address, they would not be as suitable for the purposes of the present invention as heretofore described.

SUMMARY OF THE INVENTION

A primary object of the present invention is to provide a mini-drafting machine that will overcome the shortcomings of the prior art devices.

Another object is to provide a mini-drafting machine that has a multipurpose function as a T-square, triangle, compass, protractor, scale and template for making circles, ellipses, squares, triangles, hexagons and arrows.

An additional object is to provide a mini-drafting machine that is handy, portable, not heavy to carry anywhere and can be used by students in schools, employees in offices of drafting and engineering, construction firms and even for personal use at home all over the work.

A further object is to provide a mini-drafting machine that is simple and easy to use.

A still further object is to provide a mini-drafting machine that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 3A:
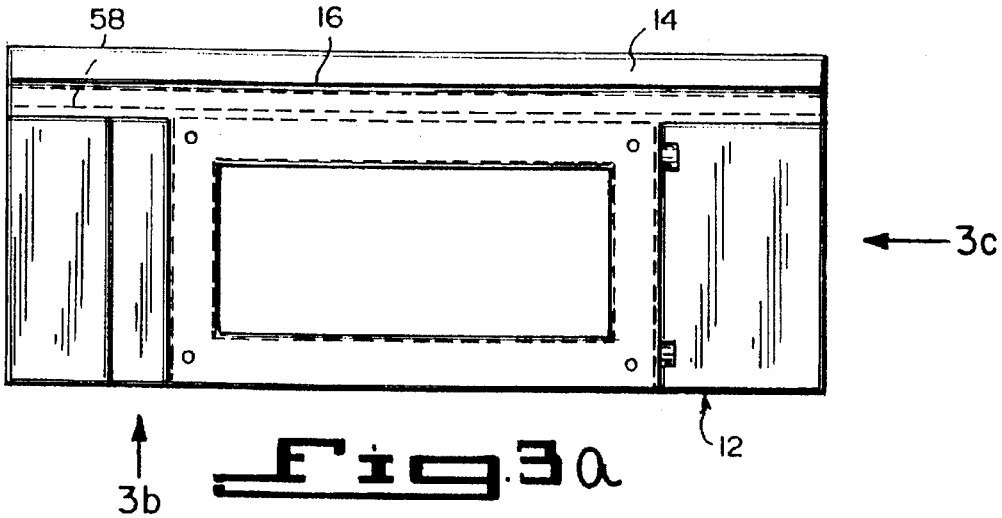

FIG. 3*a* is a top view of just the body with the template areas shown blank.

Figure 3B:
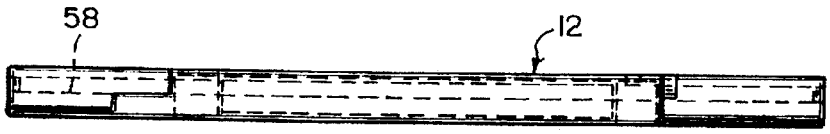

FIG. 3*b* is a front view taken in the direction of arrow 3*b* in FIG. 3*a*.

Figure 3C:
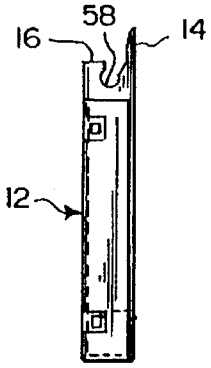

FIG. 3*c* is a right side view taken in the direction of arrow 3*c* in FIG. 3*a* and rotated ninety degrees.

Figure 1:
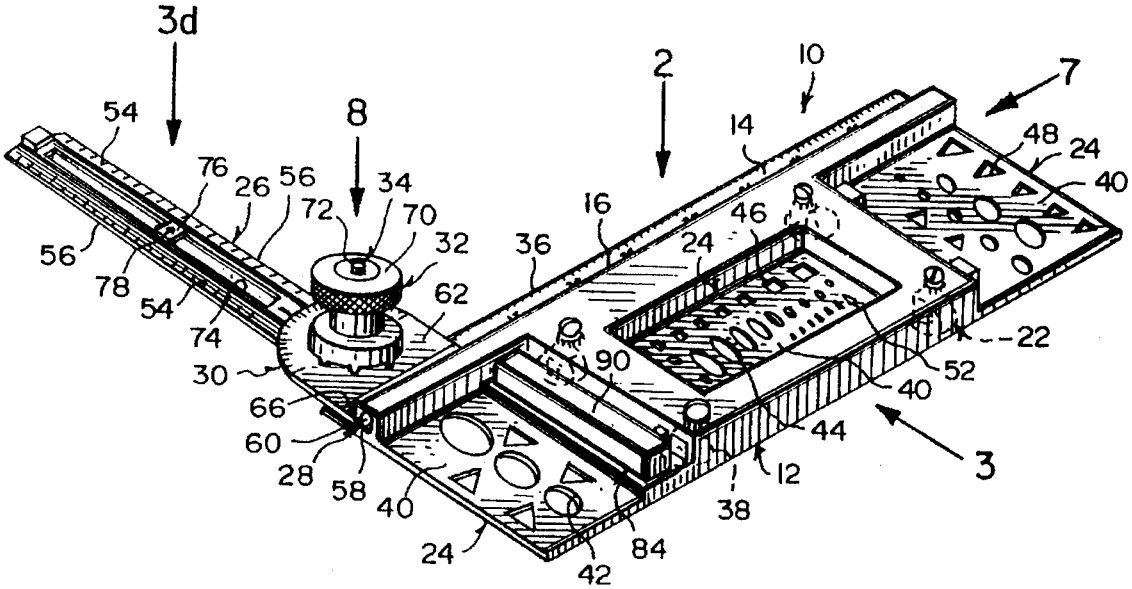
FIG. 1 is a perspective view of the instant invention.
Figure 3D:
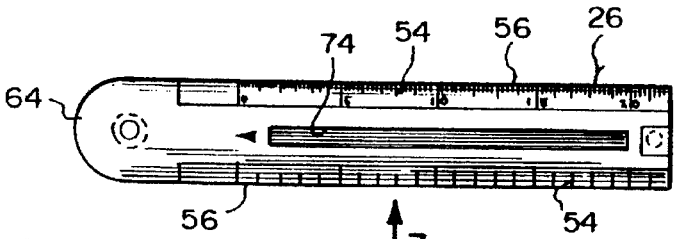

FIG. 3*d* is an enlarged top view of the adjustable arm as indicated by arrow 3*d* in FIG. 1.

Figure 3E:
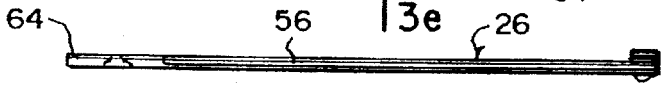

FIG. 3*e* is a side view taken in the direction of arrow 3*e* in FIG. 3*d*.

Figure 2:
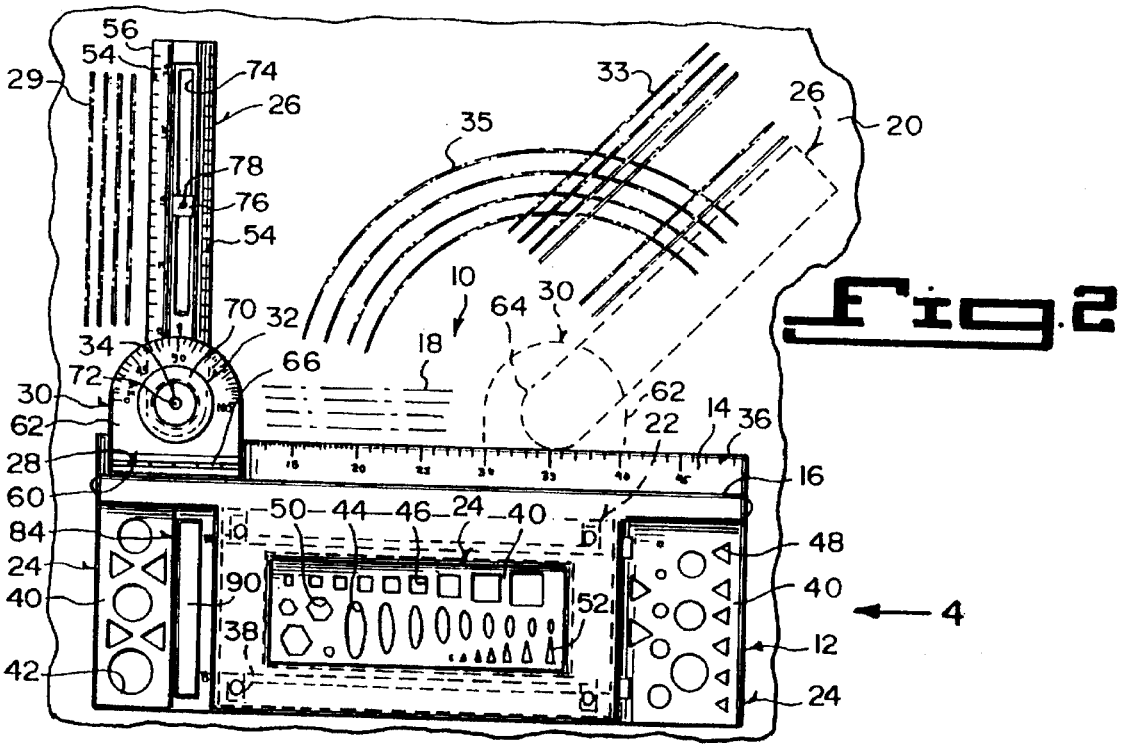
FIG. 2 is a top view taken in the direction of arrow 2 in FIG. 1.
Figure 3:
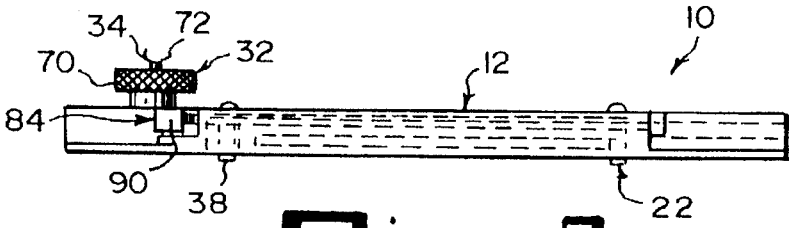
FIG. 3 is a front view taken in the direction of arrow 3 in FIG. 2.
Figure 4:
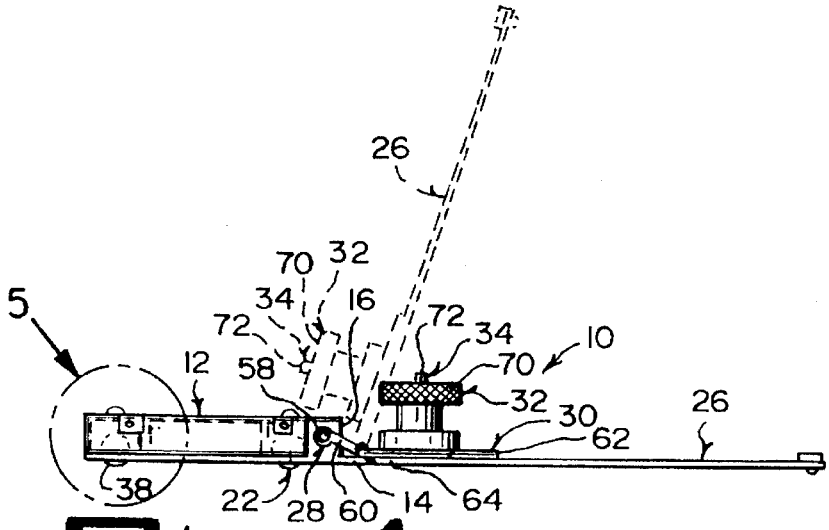

FIG. 4 is a right side view taken in the direction of arrow 4 in FIG. 2.

Figure 5:
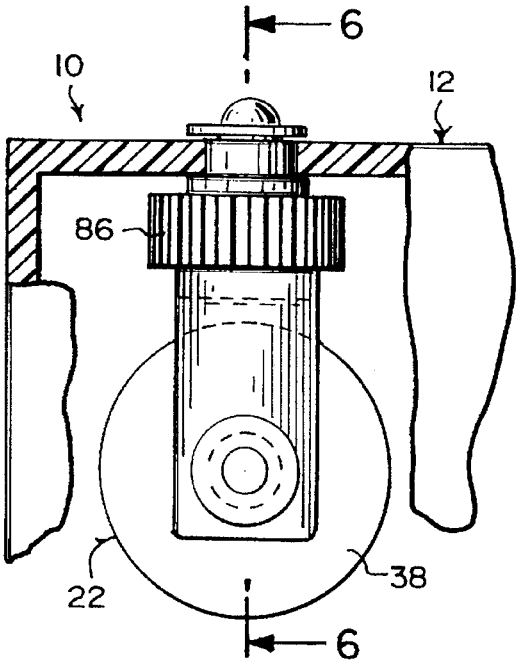

FIG. 5 is an enlarged elevational view of the area in FIG. 4 as indicated by arrow 5, with parts broken away and in section, showing one wheel assembly in greater detail.

Figure 6:
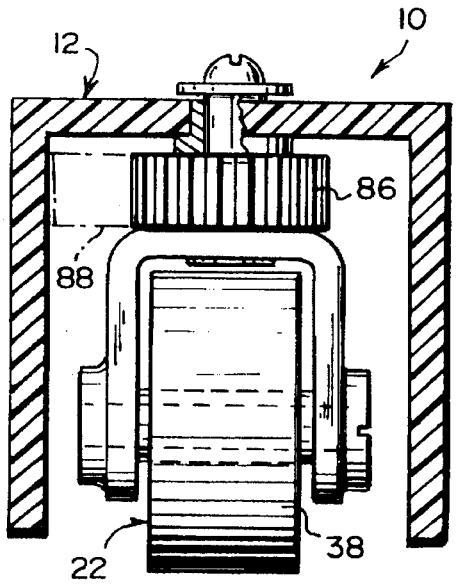

FIG. 6 is a cross sectional view taken along line 6—6 in FIG. 5.

Figure 7C:
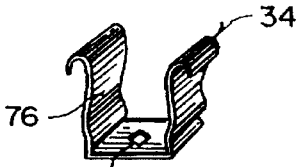
Figure 7:
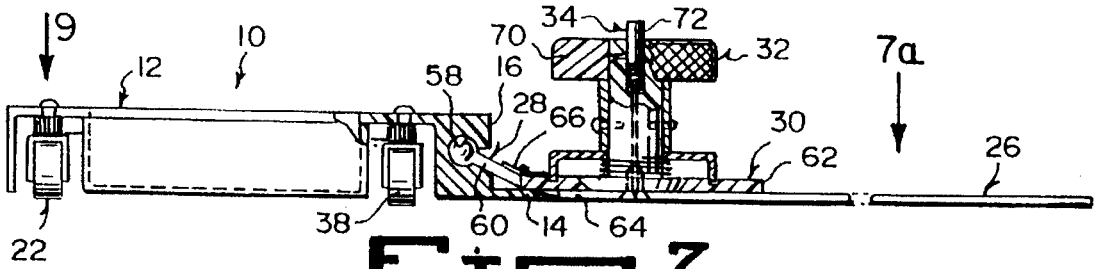

FIG. 7 is an enlarged right side view taken in the direction of arrow 7 in FIG. 1, with parts broken away and in section.

Figure 7B:
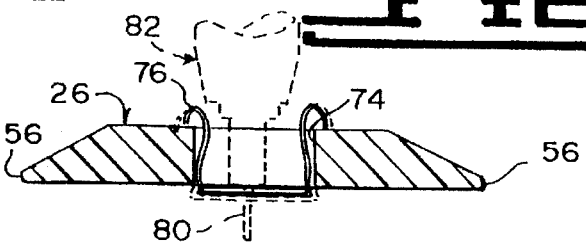
Figure 7A:
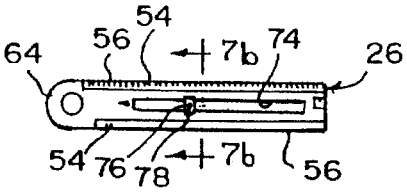

FIG. 7*a* is a top view of the adjustable arm with slide holder taken in the direction of arrow 7*a* in FIG. 7.

FIG. 7*b* is an enlarged cross sectional view taken along line 7*b*–7*b* in FIG. 7*a* with the pen shown in dotted lines.

FIG. 7*c* is a perspective view of the slide holder.

Figure 8:
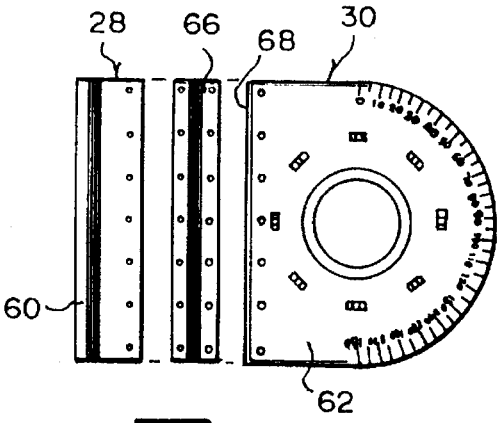

FIG. 8 is an exploded top view taken in the direction of arrow 8 in FIG. 1 of the protractor, hinge and slide rail.

Figure 9:
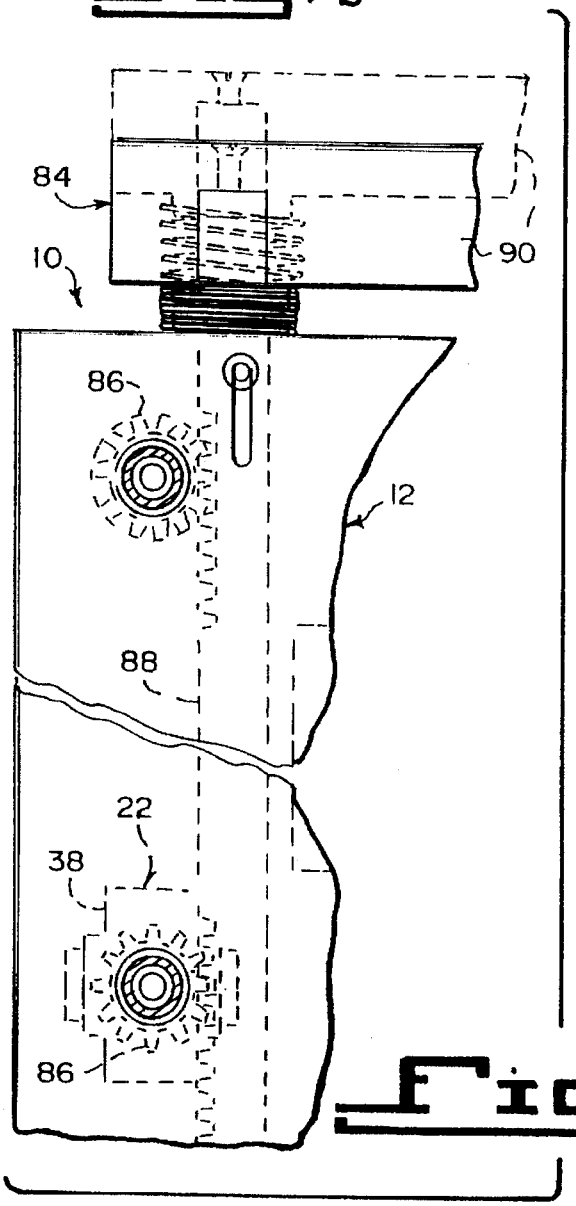

FIG. 9 is an enlarged top view taken in the direction of arrow 9 in FIG. 7, with parts broken away and in section, showing the mechanism for rotating the wheel assemblies in dotted lines.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 9 illustrate a mini-drafting machine 10, which comprises a body member 12 having a horizontal straight blade 14 along a top side edge 16 for drawing a horizontal line 18 on a flat surface 20, such as a piece of paper. An assemblage 22 is for guiding the body member 12 vertically along the flat surface 20, so that the horizontal straight blade 14 can be utilized for drawing a plurality of horizontal parallel lines 18 on the flat surface 20. A facility 24 in the body member 12 is for making different sized geometric shapes on the flat surface 20.

An adjustable arm 26 extends away from the top side edge 16 of the body member 12. A structure 28 is for guiding the adjustable arm horizontally along the top side edge 16 of the body member 12. The adjustable arm 26 can be utilized for drawing a plurality of vertical parallel lines 29 on the flat surface 20.

An apparatus 30 is for allowing rotation of the adjustable arm 26 at the top side edge 16 of the body member 12 at different angles. A device 32 is for locking the adjustable arm 26 at any one angle, so that the adjustable arm 26 can be utilized for drawing a plurality of diagonal parallel lines 33 on the flat surface 20.

A unit 34 is for drawing a plurality of different sized arcs and circles 35 on the flat surface 20. The horizontal straight blade 14 includes a scale 36 therealong. The scale 36 can be used in measuring the horizontal lines 18 drawing on the flat surface 20 with the horizontal straight blade 14.

The body member guiding assemblage 22 consists of a plurality of wheel assemblies 38 rotatively mounted to the underside of the body member 12, so that the wheel assemblies 38 can roll along on the flat surface 20. The geometric shape making facility 24, as best seen in FIGS. 1 and 2, includes a plurality of templates 40 formed into the body member 12. The templates 40 have different sized apertures of circles 42, ellipses 44, squares 46, triangles 48, hexagons 50 and arrows 52.

The adjustable arm 26 contains a scale 54 along each long edge 56. Each scale 54 can be used in measuring the vertical lines 29 and diagonal lines 33 drawn on the flat surface 20 with the adjustable arm 26. The adjustable arm guiding structure 28 consists of the top side edge 16 of the body member 12 having a horizontal track 58 therealong. A slide rail 60 fits into and moves along the horizontal track 58.

The rotation allowing apparatus 30 contains a protractor 62 for measuring angles, in which one end 64 of the adjustable arm 26 is pivotally connected to the underside of the protractor 62. A hinge 66 is for attaching a straight side 68 of the protractor 62 to the slide rail 60. The locking device 32 is a spring biased handle assembly 70 centrally located on the protractor 62. When the handle assembly 70 is pressed down, it will lock the adjustable arm 26 to the protractor 62.

The arc and circle drawing unit 34 includes a spring biased push pin 72 centrally located in the locking device 32. When the push pin 72 is pressed down, it will make contact with the flat surface 20. The adjustable arm 26 has an elongated longitudinal central slot 74 between the opposite long edges 56. A slide holder 76, as best seen in FIG. 7*c*, has a hole 78 therein. The slide holder 76 fits in a sliding manner into the elongated longitudinal center slot 74 in the adjustable arm 26. A tip 80 of a writing instrument 82, such as a pen or pencil, as shown in FIG. 7*b*, can engage within the hole 78. The adjustable arm 26 can pivot about the push pin 72 with the tip 80 of the writing instrument 82, making the arcs and circles 35 on the flat surface 20.

The mini-drafting machine 10 further contains a mechanism 84 for rotating the wheel assemblies 38 ninety degrees. The wheel assemblies 38 can go from guiding the body member 12 vertically along the flat surface 20 to guiding the body member 12 horizontally along the flat surface 20. The rotating mechanism 84, as best seen in FIG. 9, consists of each said wheel assembly 38 having a pinion gear 86 mounted thereto. A pair of spaced apart racks 88 are carried in the body member 12. Each rack 88 can engage with two pinion gears 86. A spring biased push bar 90 is connected to the racks 88. When the push bar 90 is pressed, the racks 88 will rotate the pinion gears 86 ninety degrees, causing the wheel assemblies 38 to also pivot ninety degrees, to change direction of movement of the body member 12 from a vertical direction to a horizontal direction along the flat surface 20.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A mini-drafting machine which comprises:

a) a body member having a horizontal straight blade along a top side edge for drawing a horizontal line on a flat surface;

b) means for guiding said body member vertically along the flat surface comprising two pair of spaced independently mounted and rotatable wheel assemblies on the underside of said body member normally oriented to permit paid body member to roll vertically to permit the drawing of parallel horizontal lines by said horizontal straight edge, each wheel assembly having a wheel with a pinion gear mounted thereon for rotating each wheel assembly with respect to said body, a pair of spaced apart racks carried in said body member engaging the pinion gear in each pair of wheel assemblies, spring biased push bar means mounted on the upper side of said body member for engaging said racks so that when said push bar is pressed against the spring biasing said racks will rotate said pinion gears to ninety degrees causing said wheels to also pivot the ninety degrees to change direction of movement of the body member from a vertical direction to a horizontal direction along the flat surface without rotating said body on said flat surface;

c) means in said body member for making different sized geometric shapes on the flat surface.

2. A mini-drafting machine as recited in claim 1, further including:

a) an adjustable arm extending away from the top side edge of said body member; and b) means for guiding said adjustable arm horizontally along the top side edge of said body member, so that said adjustable arm can be utilized for drawing a plurality of vertical parallel lines on the flat surface.

3. A mini-drafting machine as recited in claim 2, further including:

a) means for allowing rotation of said adjustable arm at the top side edge of said body member at different angles; and b) means for locking said adjustable arm at any one angle, so that said adjustable arm can be utilized for drawing a plurality of diagonal parallel lines on the flat surface.

4. A mini-drafting machine as recited in claim 3, further including means for drawing a plurality of different sized arcs and circles on the flat surface.

5. A mini-drafting machine as recited in claim 1, wherein said horizontal straight blade includes a scale therealong, so that said scale can be used in measuring the horizontal lines drawn on the flat surface with said horizontal straight blade.

6. A mini-drafting machine as recited in claim 1, wherein said geometric shape making means includes a plurality of templates formed into said body member, whereby said templates have different sized apertures of circles, ellipses, squares, triangles, hexagons and arrows.

7. A mini-drafting machine as recited in claim 2, wherein said adjustable arm includes a scale along each long edge, so that each scale can be used in measuring the lines drawn on the flat surface with said adjustable arm.

8. A mini-drafting machine as recited in claim 3, wherein said adjustable arm guiding means includes:

a) said top side edge of said body member having a horizontal track therealong; and b) a slide rail to fit into and move along said horizontal track.

9. A mini-drafting machine as recited in claim 8, wherein said rotation allowing means includes:

a) a protractor for measuring angles, in which one end of said adjustable arm is pivotally connected to the underside of said protractor; and b) a hinge for attaching a straight side of said protractor to said slide rail.

10. A mini-drafting machine as recited in claim 9, wherein said locking means is a spring biased handle assembly centrally located on said protractor, so that when said handle assembly is pressed down it will lock said adjustable arm to said protractor.

11. A mini-drafting machine as recited in claim 4, wherein said arc and circle drawing means includes:

a) a spring biased push pin centrally located in said locking means, so that when said push pin is pressed down, it will make contact with the flat surface;

b) said adjustable arm having an elongated longitudinal central slot between opposite long edges; and c) a slide holder having a hole therein, said slide holder fits in a sliding manner into said elongated longitudinal center slot in said adjustable arm, so that a tip of a writing instrument can engage within said hole and said adjustable arm can pivot about said push pin with the tip of the writing instrument making the arcs and circles on the flat surface.

* * * * *